US006710021B1

(12) United States Patent
Fisher

(10) Patent No.: US 6,710,021 B1
(45) Date of Patent: Mar. 23, 2004

(54) NON-STAINING, ACTIVE METAL-WORKING FLUID

(75) Inventor: Edward A. Y. Fisher, East Hampton, CT (US)

(73) Assignee: Henkel Loctite Corporation, Rocky Hill, CT (US)

( * ) Notice: Subject to any disclaimer, the term of this patent is extended or adjusted under 35 U.S.C. 154(b) by 0 days.

(21) Appl. No.: 10/088,121

(22) PCT Filed: Sep. 22, 2000

(86) PCT No.: PCT/US00/26167

§ 371 (c)(1),
(2), (4) Date: Jul. 25, 2002

(87) PCT Pub. No.: WO01/21740

PCT Pub. Date: Mar. 29, 2001

Related U.S. Application Data

(60) Provisional application No. 60/155,345, filed on Sep. 22, 1999.

(51) Int. Cl.[7] ..... C10M 125/06; C10M 129/68

(52) U.S. Cl. ..... 508/152; 508/463; 508/496; 72/42

(58) Field of Search ..... 508/152

(56) References Cited

U.S. PATENT DOCUMENTS

| | | | | |
|---|---|---|---|---|
| 4,073,736 | A | 2/1978 | Schick et al. | 252/31 |
| 4,125,471 | A | 11/1978 | Vienna et al. | 252/31 |
| 4,416,788 | A | 11/1983 | Apikos | 252/31 |
| 4,605,507 | A | 8/1986 | Windgassen et al. | 252/45 |
| 5,726,130 | A | 3/1998 | Yamanaka | 508/152 |

*Primary Examiner*—Ellen McAvoy
(74) *Attorney, Agent, or Firm*—Steven C. Bauman

(57) ABSTRACT

Non-staining, active metal-working compositions are disclosed. The compositions contain active sulfur to provide extreme pressure properties for metal-working fluids. A metal corrosion inhibitor is disclosed that reduces the corrosivity of free sulfur on non-ferrous metallic objects.

19 Claims, No Drawings

NON-STAINING, ACTIVE METAL-WORKING FLUID

This application claims benefit of Provisional Application No. 60/155,345 filed Sep. 2, 1999.

BACKGROUND OF THE INVENTION

1. Field of the Invention

The present invention relates generally to compositions for lubricating articles in metalworking operations. More particularly the present invention relates to lubricating compositions, which are non-corrosive and non-staining to non-ferrous metals.

2. Brief Description of Related Technology

Metalworking processes mechanically shape and work metallic articles or work pieces. Lubricating fluids are often used on the work pieces in metalworking processes to reduce friction between a tool and the work piece and to dissipate heat resulting from any remaining friction. The reduction of friction and dissipation of heat promotes tool life, increases production and allows the attainment of high quality finished metal products.

Metalworking operations mechanically shape and work metallic work pieces by cutting and non-cutting operations. The cutting processes include, for instance, drilling, grinding, milling, tapping, turning and broaching. Non-cutting processes include, for example, rolling, drawing, extrusion, drawing and ironing, punching, stamping and spinning processes. These metal working processes are often characterized into three general categories (for instance, light duty, medium duty and heavy duty) according to severity of the operation. Light duty jobs may include boring and milling. Medium duty may include tapping, reaming and gear cutting. Heavy duty may include broaching and threading. Increased friction and increased heat generation generally coincide with increased severity or duty of a particular metalworking process.

The type of metal also often influences the duty of the metalworking operation. For example, a metalworking operation on a stainless steel is often a more severe, operation than a similar operation on a carbon steel due to the higher strength of the stainless steel.

Lubricating fluids for metalworking operations are also distinguished by duty corresponding to a particular metalworking operation. A light duty fluid is generally appropriate for lubricating light duty metalworking operations. A heavy duty fluid has greater lubricity characteristics than a light duty fluid and is generally appropriate for lubrication in a heavy duty operation. Increased lubricity of a heavy duty fluid is often partially achieved through the use of a more viscous oil than used for light duty fluid.

Additives may also be incorporated into a heavy duty metalworking fluid to increase the lubricity of the fluid at metal-to-metal contact points, such at points where a tool contacts a work piece. Sulfur is a common additive used to increase lubricity at metal-to-metal contact points. Many fluids would not function as a heavy duty metalworking lubricant without the use of a sulfur additive.

A heavy duty lubricant containing sulfur, however, may not always be appropriate for the lower duty operations or heavy duty operations with particular work pieces. While a sulfur-containing heavy duty fluid can generally provide adequate lubricity for light, medium and heavy duty metalworking operations, sulfur-containing heavy duty fluids often stain or corrode non-ferrous metals. As such, there is a need for a sulfur-containing metalworking fluid suitable for heavy-duty operations, which does not stain or corrode nonferrous metals.

SUMMARY OF THE INVENTION

The present invention provides compositions for heavy duty metalworking fluids that do not corrode or severely stain nonferrous metals. The inventive compositions also provide greater lubricity for metalworking processes using ferrous and nonferrous metals. Improved product finishes result from the use of the inventive compositions on both ferrous and nonferrous metallic articles.

In one aspect the present invention provides a metalworking fluid composition that does not stain non-ferrous metals and is useful for heavy duty metalworking operations thereon. In one desirable feature the present inventions contains greater quantities sulfur than previously achieved in the prior art to increase lubricity and wear characteristics of a metalworking oil without staining nonferrous articles.

In another aspect of the present invention lubricating compositions are provided which include a fatty oil to inhibit staining of non-ferrous metals during metalworking processing. Useful fatty oils include monoglycerides, diglycerides, triglycerides, esters of monocarboxylic acids, esters of dicarboxylic acids and combinations thereof. The fatty oils may also be sulfurized, chlorinated or chlorosulfurized.

The invention will now be described with reference to the section entitled "Detailed Description of the Invention."

DETAILED DESCRIPTION OF THE INVENTION

The present invention relates to metalworking fluid compositions suitable for heavy duty metalworking processes without the disadvantages described above. A metalworking lubricant serves many functions, including use as a heat-transfer medium, providing protection against rust and corrosion, and serving as a carrier for debris. Among the many other advantages and uses of the inventive metalworking compositions are (1) preventing corrosion and staining of the tool and the work piece; (2) keeping a metalworking tool cool and preventing it from being heated to a temperature at which the hardness and resistance to abrasion are reduced; (3) maintaining the work piece cool, thereby preventing it from being machined in a warped shape to inaccurate final dimensions; (4) providing a good finish on the work piece; (5) aiding in satisfactory chip formation to promote the metalworking operation; (6) washing away chips, especially in deep-hole drilling, milling and grinding; (7) lubricating moving machine parts close to the cutting tool; and (8) reducing power consumption of the metalworking operation through lubrication.

In one aspect the inventive composition is an oil-based lubricant. An oil-based fluid composition is particularly useful in metalworking operations where lubrication and high grade finishing cuts are especially desirable, or where aqueous fluids adversely effect product finishes. For example, frictional heat from the metalworking operation is dissipated in an oil film resulting from application of the oil onto a work piece. The amount of heat dissipated is generally related to the film thickness, fluid velocity and fluid density. Insufficient heat dissipation can often cause high fluid temperatures that decrease the viscosity of the oil sufficiently to break down the film. Such a film breakdown can result in metal-to-metal contact between the tool and the work piece. Metal-to-metal contact can often result in failure of the tool, the work piece, or both the tool and the work piece.

Thus, film thickness, fluid density, velocity and viscosity are important properties for such an oil-based lubricating composition. High severity or heavy-duty metalworking operations generally require oil-based lubricants with a high viscosity to provide adequate lubrication. Oil-based lubricants may be broadly classified into duties based on their viscosity. The viscosity ranges described herein are not intended to limit the scope of the invention, but are generally recognized in the industry and are intended to serve as examples to aid in the understanding of the invention. A light duty fluid generally has a kinematic viscosity from about 10 cSt (centistokes) at 25° C. to about 30 cSt at 25° C. A medium duty fluid generally has a kinematic viscosity from about 30 cSt at 25° C. to about 75 cSt at 25° C. A heavy-duty fluid generally has a kinematic viscosity greater than 75 cSt at 25° C. A heavy-duty fluid which has a maximum kinematic viscosity of 160 cSt at 25° C. is particularly useful as a heavy duty metalworking fluid.

In another aspect of the present invention, an inventive composition which serves as a heavy duty metalworking fluid with a kinematic viscosity range of about 75 cSt to about 160 cSt at 25° C. is useful. Desirably, compositions of the present invention may have a kinematic viscosity range of about 75 cSt to about 90 cSt at 25° C.; and more desirably may have kinematic viscosity ranges of about 20 cSt to about 60 cSt at 40° C. and about 4 cSt to about 8 cSt at 100° C.

The viscosity of the lubricating oil used in the inventive compositions may be selected by choosing an appropriate base oil or by mixing various base oils. Appropriate base oils include lubricating oil fractions of naphthenic, paraffinic or naphthenic/paraffinic petroleum. These lubricating oil fractions may be unrefined, acid-refined, solvent-refined, hydrotreated or hydrocracked as required by the particular lubricating need. Lubricating oil fractions and hydrotreated or hydrocracked oil fractions obtained from vacuum distillation of petroleum are also useful.

Mixing of various base oils may also be useful for obtaining a desired viscosity of the inventive composition.

Among useful base oils are lubricating oil fractions of International Standards Organization (ISO) grade numbers 22, 32, 46, 68 and combinations thereof. The ISO grade numbers are approved for classifying industrial lubricants according to a mid-point of a viscosity range expressed in centistokes at 40° C. as shown below in Table 1. Other ISO grade numbers are also useful with the practice of the present invention

TABLE 1

| ISO Viscosity Grade | Viscosity Grade Ranges in Centistokes at 40° C. | |
|---|---|---|
| Number | Minimum | Maximum |
| 22 | 19.8 | 24.2 |
| 32 | 28.8 | 35.2 |
| 46 | 41.4 | 50.6 |
| 68 | 61.2 | 74.8 |

Useful base oils may also include oils from animals, oils from plants, synthetic oils and combinations thereof. Oils of lubricating viscosity derived from coal, shale or tar sands are also useful.

Useful synthetic lubricating oils include, without limitation, hydrocarbon oils and halo-substituted hydrocarbon oils such as polymerized and interpolymerized olefins; alkylbenzenes; polyphenyls; alkylated diphenyl ethers and alkylated diphenyl sulfides. Another useful class of useful synthetic lubricating oils includes the esters of dicarboxylic acids of relatively low acid number, for instance dibutyl adipate, di(2-ethylhexyl) sebacate, di-n-hexyl fumarate, dioctyl sebacate, diisoctyl azelate, diisodecyl azelate, dioctyl phthalate, didecyl phthalate, and dieicosyl sebacate. Esters useful as synthetic oils also include those made from $C_5$to $C_{12}$ monocarboxylic acids, polyols and polyol ethers such as neopentyl glycol, trimethylolpropane, pentaerythritol, dipentaerythritol and tripentaerythritol.

Metalworking lubricants, especially heavy duty lubricants, are also often distinguished as being suitable or unsuitable for extreme pressure applications. An extreme pressure lubricant is a lubricant that prevents sliding metal surfaces from seizing under extreme pressure conditions. The seizing of metal surfaces result from friction between opposing asperities. Asperities are microscopic projections on metal surfaces resulting from metalworking operations. Interference between opposing asperities in sliding or rolling applications is a source of friction and can lead to metal welding and scoring.

One technique for measuring extreme pressure properties of a lubricant is to measure a load force between sliding surfaces which can be sustained by lubricant without seizing of the sliding surfaces. Such a technique is described as a Falex load test, which is an ASTM standard test for fluid lubricants (ASTM D 3233). As used herein the phrase "extreme-pressure composition" and its variants refer to a composition that has a Falex reference load of 1,000 pounds force or greater. The Falex load test is further described herein in conjunction with Example 2.

Typically a lubricant additive is incorporated into an appropriate base oil to obtain a lubricant that prevents sliding metal surfaces from seizing under conditions of extreme pressure (EP). At the local high temperatures associated with metal-to-metal contact, an EP additive is believed to interact with the metal to form a surface film that prevents the welding of opposing asperities, and the consequent scoring or seizing that is destructive to sliding surfaces under high loads. Compounds of sulfur, chlorine, phosphorus and combinations thereof are useful as EP additives with the present invention. In one aspect of the present invention, the lubricant contains from 0 to about 3 weight percent chlorine, from 0 to about 2 weight percent phosphorus and from 0 to about 4 weight percent chemical bound sulfur, such as the sulfur contained in t-dodecyl polysulfide.

Metalworking lubricants that contain EP additives are typically classified as "active" as compared to lubricants without EP additives, which are typically classified as "inactive". As used herein the term "active" and its variants refer to an additive or a fluid that is stable at room temperatures but provides necessary protection against metal seizing, galling or scoring in the high-friction, high-temperature metal-to-metal contact areas.

In a further aspect of the present invention, active sulfur is included to provide adequate lubrication at extreme pressure conditions. The sulfur is combined with the lubricating oil by sulfurizing techniques which include contacting an oil and a sulfur compound at high temperatures under an inert atmosphere. Sulfur, which when contacted with the oil, reacts with the oil and becomes chemically bound by the oil molecules is referred to as inactive or reacted sulfur. Unreacted sulfur is sulfur which for instance when heated with stabilizing oil is held in solution and is not chemically bound by the oil molecules. The unreacted or free sulfur is the component which provides the extreme pressure and metal cutting lubricant properties. The unreacted sulfur may include those sulfur atoms bound by sulfur-to-sulfur bonds. As used herein the phrase "free sulfur" and its variants refer to sulfur in a lubricating fluid composition which reacts with metallic copper at a temperature of 149° C. (300° F.) as prescribed in ASTM D 1662 test method. A desirable free sulfur is Elco 240, available from the Elco Corporation of Cleveland, Ohio.

Although free sulfur is active for extreme pressure lubricants in metalworking processes, free sulfur often corrodes nonferrous articles. Thus, in another aspect of the present invention, the lubricating composition includes one or more materials that inhibit the corrosive effects of free sulfur, without inhibiting or otherwise detracting from the extreme pressure lubricating effects of free sulfur. Fatty oils having monoglycerides, diglycerides, triglycerides, esters of monocarboxylic acids and esters of dicarboxylic acids are useful as such materials and serve to inhibit the corrosive effects of free sulfur, while maintaining the sulfur active for extreme pressure lubrication. The fatty oils present from 5 to 30 volume percent of the lubricating composition are useful with the present invention. While not intended to be bound by a particular theory, one possible explanation for these beneficial effects of incorporating fatty oils may be due to their polar nature which results in an attraction of the fatty oil to the metallic surface thereby providing a barrier against corrosive metal-to-sulfur bonding.

The availability of free sulfur, proximal to the metallic surface is believed to provide extreme pressure lubricating properties to the composition, without the deleterious corrosion effects frequently caused by sulfur on metallic surfaces.

Fatty oils useful with the present invention include glycerides having the following formula:

(I)

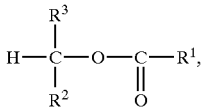

where $R^1$ is a saturated or unsaturated $C_3$ to $C_{24}$ aliphatic hydrocarbon, and $R^2$ and $R^3$ are the same or different and can be hydrogen or (II)

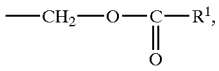

where $R^1$ is as defined above.

Fatty oils useful with the present invention also include esters of carboxylic acids having the following formula:

(III)

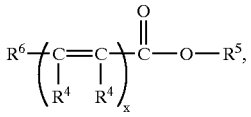

where $R^4$ is hydrogen or a saturated or unsaturated $C_3$ to $C_{12}$ aliphatic hydrocarbon, X is 1, 2 or 3, $R^5$ is a saturated or unsaturated $C_3$ to $C_{24}$, aliphatic hydrocarbon, and $R^6$ is defined by the following formula:

(IV)

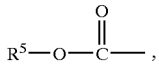

where $R^5$ is as defined above. Desirably the base oil is a hydrotreated naphthenic oil, such as Chevron Metalworking Fluid Grade 45A, available from Chevron Products Company, San Francisco, Calif., which includes about 18 volume percent fatty oil as described above.

The present invention has improved capability for lubricating surfaces under extreme pressure conditions. The capability to lubricate under extreme pressures is evaluated by a standard test as described in Example 2A. Lubricating capabilities that result in greater than 4,500 pounds-force (lbf.) as measured by ASTM D 3233A are useful with the present invention.

Furthermore, the present invention has improved lubricating capability for reducing wear between contacting surfaces. The lubricating capability to reduce wear is evaluated by a standard test as described in Example 2B. Lubricating capabilities that result in reduce wear of less than 10 teeth as measured by ASTM D 2670 are useful with the present invention.

Moreover, the present invention also has improved anti-wear property for surfaces in sliding contact with one and the other. The anti-wear property is evaluated by a standard test as described in Example 4. Anti-wear properties that result in an average wear scar diameter of less than 0.07 mm as measured by ASTM D 4172 are useful with the present invention.

The present invention is further described below in the following examples, which are intended to further elucidate the invention, and are not to be construed, in any way as limiting.

EXAMPLES

Example 1

Corrosivity Tests

Active metalworking lubricating fluid compositions were prepared by combining active sulfur in the form of alkylpolysulfide into two base oil compositions. Both base oil compositions were hydrotreated lubricating oil fractions of petroleum.

The first composition represented a control lubricating composition. The base oil for this composition is a hydrotreated paraffin oil and is available commercially as Chevron Neutral Oil 100R from Chevron Products Company.

The second composition was representative of an inventive composition (inventive composition one), and contained a fatty oil characterized as a $C_8$ to $C_{20}$ triglyceride having a fatty oil species of $C_{14}$ and $C_{18}$ hydrocarbon numbers to inhibit the corrosive effects of free sulfur. The base oil of this composition was Chevron Metalworking Fluid Grade 45A. Properties of these compositions are shown below in Table 2.

Active sulfur, such as Elco 240, was added to both of these compositions. Up to about 1.4 weight percent active sulfur was added to the control composition and up to about 14.4 weight percent active sulfur was added to the inventive composition. Corrosivity of the compositions were then determined by standard test methods as described herein.

The Copper Strip Corrosion Test (ASTM D 130) determines corrosivity of lubricating oils towards nonferrous metals. In this test a copper strip is immersed into a lubricating oil composition containing the test additive. The lubricating oil composition is maintained at 100° C. (212° F.) for 2 hours. The degree of discoloration of the copper strip is obtained from an ASTM standard comparison chart. A rating of 1a indicates a very low degree of discoloration and consequently very slight corrosivity of the lubricating oil composition towards copper.

Ratings of higher numbers, such as 4a or 4b, show higher reactivity, which indicate severe corrosion of the copper strip. The results of testing the inventive composition and the control composition in the Copper Strip Corrosion Test arealso set forth in Table 2.

TABLE 2

Copper Strip Corrosivity Tests, ASTM D 130

| Description | Control Lubricating Composition | Inventive Lubricating Composition One |
|---|---|---|
| Specific Gravity | 0.86 at 15.6° C. | 0.91 at 15° C. |
| Kinematic Viscosity | | |
| cSt at 25° C. | 34.0 | 86.5 |
| cSt at 40° C. | 19.7 | 38.8 |
| cSt at 100° C. | 4.0 | 6.2 |
| Sulfur, Total | 10 ppm | 2.2 Wt. % |
| Sulfur, Active, ASTM D 1662 | — | — |
| Fatty Oil, Vol. % | — | 18.2 |
| Active Sulfur, Wt % of Total Composition | Classification | Classification |
| 0.0 | 1b | 1b |
| 0.4 | 4a | 1b |
| 0.7 | 4b | 1b |
| 1.1 | 4b | 1b |
| 1.4 | 4b | 1b |
| 3.6 | — | 2b |
| 7.2 | — | 3a |
| 10.8 | — | 3b |
| 14.4 | — | 4b |

The fatty oil present in the inventive composition proved effective in inhibiting corrosivity effects of free sulfur. The inventive composition with the fatty oil did not corrode the copper strip until the active sulfur was increased to about 14.4 weight percent. The control sample without the fatty oil corroded the copper strip at about 0.4 weight percent active sulfur. For reference, the classifications of the Corrosivity Tests, Copper Strip ASTM D 130 are shown below in Table 3.

TABLE 3

Corrosivity Tests, Copper Strip ASTM D 130

| Classification | Designation | Description |
|---|---|---|
| 1a | Slight Tarnish | Light Orange, almost the same as freshly polished strip |
| 1b | Slight Tarnish | Dark Orange |
| 2a | Moderate Tarnish | Claret red |
| 2b | Moderate Tarnish | Lavender |
| 2c | Moderate Tarnish | Multicolored with lavender blue or silver, or both, overlaid on claret red |
| 2d | Moderate Tarnish | silvery |

TABLE 3-continued

Corrosivity Tests, Copper Strip ASTM D 130

| Classification | Designation | Description |
|---|---|---|
| 2e | Moderate Tarnish | Brassy or gold |
| 3a | Dark Tarnish | Magenta overcast on brassy strip |
| 3b | Dark Tarnish | Multicolored with red and green showing (peacock), but no gray |
| 4a | Corrosion | Transparent black, dark gray or brown with peacock green barely showing |
| 4b | Corrosion | Graphite of lusterless black |
| 4c | Corrosion | Glossy or jet black |

Example 2

Extreme Pressure and Wear Tests for Lubricants

The inventive composition of Example 1 was tested for extreme pressure and wear properties with added active sulfur and without added active sulfur. A summary of the tests is provided below.

A. Falex Extreme Pressure Test, ASTM D 3233 (Test Method A)

The capability of lubricating oil compositions to lubricate under extreme pressures can be measured by this test. The Falex machine is manufactured by the Falex Corporation of Aurora, Ill. In this test two opposing stationary V-blocks are pressed by a nutcracker arrangement of lever arms towards each other against an interposing rotating steel pin test specimen. The rotating test specimen is driven by a chuck through a brass shear pin. The V-block and pin test specimens are immersed in a vessel of the test lubricant at a preselected temperature. The machine is operated 290 rpm and the specimens are broken in at 300 pounds-force (lbf) or 1334 Newtons (N) loading. During the test, loading between the V-blocks and the rotating pin is increased until seizure occurs or until a maximum load of 4,500 lbf (20,000 N) is applied. The failure point, if any, is indicated by shearing of the brass pin holding the rotating shaft. The load at failure in pounds is taken as a quantitative measure of the extreme-pressure properties of the oil compositions.

Mineral oils may fail at 600 to 900 lbf. Oils with moderately effective extreme-pressure additives may fail at 1,000 to 2,000 lbf and very effective extreme-pressure additives will permit loadings in excess of 4,500 lbf or no failure. The limit of the test machine is 4,500 lbf.

The results of testing oil compositions of this invention in this test are set forth in Table 4.

TABLE 4

Inventive Composition One, Lubricating Tests

| Active Sulfur, weight Percent of Total Composition | Falex Extreme Pressure Test (ASTM D 3233A), lbf. |
|---|---|
| 0.0 | 2370 |
| 1.4 | 4500+ |

Combining active sulfur into the inventive composition increased the extreme-pressure load results from a Falex reference load of 2,370 lbf without active sulfur to a Falex reference load of 4,500+ lbf with active sulfur. As used herein the phrase "Falex reference load" and its variants refer to the test results from the Falex Extreme Pressure Test (ASTM D 3233A) as described herein. These results may be compared to test results on other commercially available products as set forth in Table 5a. Other commercially available products ranged from a Falex reference load of 1,270 to 4,500 +lbf when under similar conditions.

B. Falex Wear Test, ASTM D 2670

The equipment and test specimens as detailed above for ASTM D 3233 were used for Falex wear tests. After the test specimens are immersed in the lubricant, the test specimen is rotated at 290 rpm under a load of 350 lbf for a 5 minute break-in period. The test is then run for 15 minutes under constant load of 900 lbf. As wear, if any, occurs on the test specimen, the load would decrease. The load, however, is maintained constant by advancing a ratchet wheel.

The test results report the number of teeth advanced on this ratchet wheel as required to maintain the constant load during the test period. Higher reported numbers correlate to higher degrees of wear.

The results of testing oil compositions of this invention in this test are set forth in Table 5. The inventive composition without active sulfur had a Falex reference wear of six. The Falex reference wear improved to zero when tested on an inventive composition with active sulfur. As used herein the phrase "Falex reference wear" and its variants refer the test results from the Falex Wear Test (ASTM D 2670) as described herein. These results may be compared to test results on other commercially available products as set forth in Table 5a. When tested under similar conditions, these commercially available products had Falex reference wear results from 5 to 27 with one commercial product failing the test.

TABLE 5

Inventive Composition One, Lubricating Tests

| Active Sulfur, weight Percent of Total Composition | Falex Wear Test (ASTM D 2670), No. of Teeth. |
|---|---|
| 0.0 | 6 |
| 1.4 | 0 |

As evidenced from Table 5, the inventive composition with active sulfur proved to an effective extreme pressure, heavy-duty metalworking fluid.

As evidenced below from Table 5a, none of the commercially available active, heavy duty metal working fluids provided exceptional wear and extreme pressure properties at the corrosivity rates of the compositions of the present invention. All of these commercially available products tested to be corrosive on copper strips as evidenced by ASTM D130 classifications of 4a to 4c.

TABLE 5a

Lubricating and Corrosivity Results for Commercially Available Heavy Duty, Active Metalworking Fluids

| Commercial Fluid/ (Source) | Kinematic Viscosity, cSt at 25° C. | Falex Wear Test (ASTM D 2670), Teeth | Falex Extreme Pressure Test (ASTM D 3233A), Lbs-f | Corrosivity, Cu Strip ASTM D 130 |
|---|---|---|---|---|
| Tri-Cut (LPS) | 133.3 | 27 | 4500+ | 4a |
| Omega (Mobil) | 87.1 | Fail | 1270 | 4c |

TABLE 5a-continued

Lubricating and Corrosivity Results for Commercially Available Heavy Duty, Active Metalworking Fluids

| Commercial Fluid/ (Source) | Kinematic Viscosity, cSt at 25° C. | Falex Wear Test (ASTM D 2670), Teeth | Falex Extreme Pressure Test (ASTM D 3233A), Lbs-f | Corrosivity, Cu Strip ASTM D 130 |
|---|---|---|---|---|
| 31C (Chevron) | 77.8 | 5 | 1770 | 4b |
| Rapid Tap (Relton) | 54.1 | 8 | 4500+ | 4a |

Example 3

Surface Finish

The test pins from the Falex Wear Test of Example 2 on the inventive compositions were measured for surface roughness. These test pins were standard ASTM D 2670 test pins of AISI 3135 steel with a surface finish of 5 to 10 micro inches prior to the Falex Wear Test. The surface roughness was measured by using a Surftest 211 Surface Roughness Tester, which is available from Mytutoyo Corp., located in Tokyo, Japan. The Surftest 211 measures and reports the arithmetical mean deviation of the roughness profile of a machine's surface.

The inventive composition of example 2 which did not have active sulfur had a surface roughness of about 48 micro inches. The inventive composition of example 2 with active sulfur had a surface roughness of about 23 micro inches. Thus, the inventive composition with active sulfur proved more effective in providing an improved finish on a ferrous metal work piece.

Example 4

Four-Ball Wear Test, ASTM D 4172

The capability of lubricating compositions to lubricate surfaces in sliding contact can be measured by this test. A Four-Ball Wear Test machine is utilized in this test and is manufactured by Falex Corporation of Aurora, Ill. In this test, three steel balls are clamped together and covered with a lubricating composition. A fourth ball is pressed with a specified force into a cavity formed by the three clamped balls. The temperature of the lubricating composition is maintained at about 5° C. while the fourth ball is rotated at 1200 rpm for 60 minutes. A microscope is then used to measure the diameter of scars on the three balls. The average wear scar diameter in millimeters is reported. Lower wear scar diameters indicate better anti-wear properties of a lubricating composition in sliding contact as compared to a lubricating composition resulting in higher wear scar diameters.

The inventive composition at zero and 1.4 percent active sulfur and a commercially available heavy duty, active metalworking fluid were tested under this test condition. As evidenced from Table 6, the inventive composition had lower Four-Ball wear scar diameters as compared to the other commercially available product. As used herein the phrase "Four-Ball wear scar" and its variants refer to the test results from the Four-Ball Wear Test (ASTM D 4172) as described herein. Furthermore, active sulfur also resulted in an improvement in wear scar diameter for the inventive composition.

TABLE 6

Inventive Composition One, Four-Ball Wear Scar Tests

| Lubricating Composition | Avg. Wear Scar Diameter, mm (ASTM D 4172) |
|---|---|
| Inventive Composition One at 0.0 wt. % Active Sulfur | 0.067 |
| Inventive Composition One at 1.4 wt. % Active Sulfur | 0.047 |
| Tri-Cut (LPS) | 1.35 |

Moreover, the wear scar diameters for the inventive composition can be further improved by incorporating other additives, such as inactive sulfur, into the lubricating composition. A Four-Ball wear scar of about 0.32 mm was achieved with the above inventive composition at 1.4 weight percent active sulfur with about 3 weight percent inactive sulfur (t-dodecyl-polysulfide).

While there have been described various aspects of the present invention, those skilled in the art will realize that various aspects and embodiments can be made without departing from the spirit of the present invention, and it is intended all such further modifications and changes be included within the scope of the claims.

What is claimed is:

1. A composition for lubricating metallic work pieces comprising:

(a) an oil having a viscosity of about 75 cSt to about 90 cSt at 25° C.;

(b) free sulfur in an amount sufficient to provide lubrication, and (c) a metal corrosion inhibitor to prevent corrosion of said work pieces;

wherein said metal corrosion inhibitor is a fatty oil selected from the group consisting of a glyceride, an ester of a carboxylic acid, and combinations thereof, wherein said glyceride is represented by the formula of

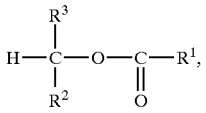

wherein $R^1$ is a saturated or unsaturated $C_3$ to $C_{24}$ aliphatic hydrocarbon, and $R^2$ or $R^3$ is hydrogen or

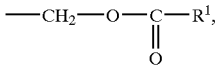

wherein $R^1$ is as defined above, and said ester is represented by the formula of

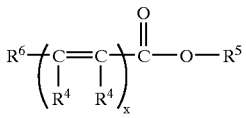

wherein $R^4$ is hydrogen or a saturated or unsaturated $C_3$ to $C_{12}$ aliphatic hydrocarbon, X is 1, 2 or 3, $R^5$ is a saturated or unsaturated $C_3$ to $C_{24}$ aliphatic hydrocarbon, and $R^6$ is represented by the formula of

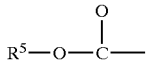

wherein $R^5$ is as defined above; and wherein said lubrication is demonstrated by a Falex reference load of greater than about 4,500 pounds force and by a Falex reference wear of less than ten teeth and further wherein said composition when maintained at 100° C. for 2 hours has a copper strip corrosion classification from about 1a to about 3b.

2. The composition of claim 1, wherein said composition is a metalworking composition.

3. The composition of claim 1, wherein said fatty oil is about 5 to about 30 volume percent based on said composition.

4. The composition of claim 1, wherein said sulfur is present in amounts of from about 0.4 to about 12 percent by weight of said composition.

5. The composition of claim 1, wherein said composition has a Four-Ball wear scar diameter of less than about 0.07 mm.

6. The composition of claim 1, wherein the metallic work pieces are nonferrous metallic work pieces.

7. A composition for lubricating nonferrous metallic work pieces comprising:

(a) an oil having a viscosity of about 75 cSt to about 90 cSt at 25° C. suitable for heavy duty metalworking operations; and (b) free sulfur being present in amounts of about 0.4 percent to about 12 percent by weight of said composition;

wherein said composition does not corrode said nonferrous work pieces and further wherein said composition when maintained at 100° C. for 2 hours has a copper strip corrosion classification from about 1a to about 3b.

8. The composition of claim 7, wherein said sulfur is not chemically bound to molecules in said oil.

9. The composition of claim 7, further comprising a fatty oil selected from the group consisting of a glyceride, an ester of a carboxylic acid, and combinations thereof, wherein said glyceride is represented by the formula of

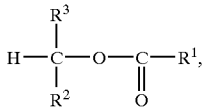

where $R^1$ is a saturated or unsaturated $C_3$ to $C_{24}$ aliphatic hydrocarbon, and $R^2$ or $R^3$ is hydrogen or

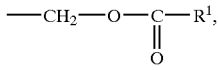

wherein $R^1$ is as defined above, and said ester is represented by the formula of

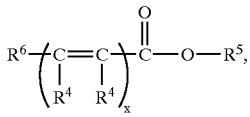

wherein $R^4$ is hydrogen or a saturated or unsaturated $C_3$ to $C_{12}$ aliphatic hydrocarbon, X is 1, 2 or 3, $R^5$ is a saturated or unsaturated $C_3$ to $C_{24}$ aliphatic hydrocarbon, and $R^6$ is represented by the formula of

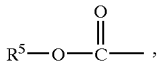

wherein $R^5$ is as defined above, said fatty oil being present in an amount of about 5 to 30 volume percent based on the total composition and said fatty oil.

10. The composition of claim 7, wherein said composition has a Falex reference wear of less than ten teeth.

11. The composition of claim 7, wherein said composition has a Falex reference load of greater than about 4,500 pounds force.

12. The composition of claim 7, wherein said composition has a Four-Ball wear scar diameter of less than about 0.07 mm.

13. The composition of claim 7, further comprising from about 0.0 to 4.0 weight percent chemically bound sulfur.

14. A method of making a composition which provides non-corrosive lubrication to nonferrous metalworking processes comprising:

selecting a base oil having a viscosity of about 75 cSt to about 90 cSt at 25° C.;

incorporating chemically unbound sulfur to said base oil to provide an extreme pressure lubricant, wherein the chemically unbound sulfur is from about 0.4 to about 12 weight percent of said composition; and further incorporating a fatty oil to inhibit nonferrous metal corrosion.

15. The method of claim 14, wherein said composition has a Falex reference wear of less than ten teeth.

16. The method of claim 14, wherein said fatty oil is selected from the group consisting of a glyceride, an ester of a carboxylic acid, and combinations thereof, wherein said glyceride is represented by the formula of

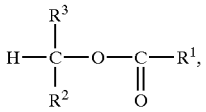

wherein $R^1$ is a saturated or unsaturated $C_3$ to $C_{24}$ aliphatic hydrocarbon and $R^2$ or $R^3$ is hydrogen or

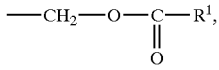

wherein $R^1$ is as defined above, and said ester is represented by the formula of

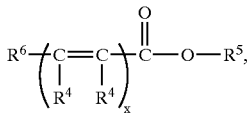

wherein $R^4$ is hydrogen or a saturated or unsaturated $C_3$ to $C_{12}$ aliphatic hydrocarbon, X is 1, 2 or 3, $R^5$ is a saturated or unsaturated $C_3$ to $C_{24}$ aliphatic hydrocarbon, and $R^6$ is represented by the formula of

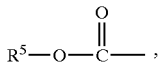

wherein $R^5$ is as defined above, and is combined into said composition in an amount from about 5 to about 30 volume percent based on the total composition and said fatty oil.

17. The method of claim 14, further comprising incorporating from about 0.0 to 4.0 weight percent chemically bound sulfur.

18. A method of providing noncorrosive lubrication to the metalworking of a nonferrous metal part comprising:

providing a composition which includes a base oil having a viscosity of about 75 cSt to about 90 cSt at 25° C. and free sulfur present in amounts sufficient to provide extreme pressure lubrication of a Falex reference load of greater than about 4,500 pounds force, wherein said composition when maintained at 100° C. for 2 hours has a copper strip corrosion classification from about 1a to about 3b; and applying said composition to the metal work part and/or a metal work tool during the metalworking process.

19. A composition for lubricating comprising:

(a) an oil having a viscosity of about 75 cSt to about 90 cSt at 25° C.;

(b) free sulfur in an amount sufficient to provide enhanced extreme pressure lubrication, and (c) a metal corrosion inhibitor to prevent corrosion of said work pieces, wherein said lubrication is demonstrated by a Four-Ball wear scar diameter of less than about 0.07 mm.

* * * * *